US006474126B1

(12) United States Patent
Webster

(10) Patent No.: US 6,474,126 B1
(45) Date of Patent: Nov. 5, 2002

(54) METHOD OF DEEP DRAWING HEAVY-GAGE PARTS, AND RELATED APPARATUS AND ARTICLE

(76) Inventor: Robert H. Webster, 47652 Pine Creek St., Northville, MI (US) 48167

( * ) Notice: Subject to any disclaimer, the term of this patent is extended or adjusted under 35 U.S.C. 154(b) by 0 days.

(21) Appl. No.: 09/661,949

(22) Filed: Sep. 14, 2000

(51) Int. Cl.[7] ..... B21D 22/21
(52) U.S. Cl. ..... 72/348; 72/347
(58) Field of Search ..... 72/343, 347, 348, 72/349

(56) References Cited

U.S. PATENT DOCUMENTS

| | | | | | |
|---|---|---|---|---|---|
| 3,197,996 | A | * | 8/1965 | Zeder, Jr. | 72/348 |
| 3,793,871 | A | | 2/1974 | Kinghorn | |
| 4,147,049 | A | | 4/1979 | Book et al. | |
| 4,339,939 | A | | 7/1982 | Book et al. | |
| 4,485,661 | A | | 12/1984 | Hehl | |
| 4,509,356 | A | | 4/1985 | Budrean et al. | |
| 4,559,802 | A | | 12/1985 | Budrean et al. | |
| 4,738,129 | A | | 4/1988 | Ford | |

FOREIGN PATENT DOCUMENTS

| | | | | |
|---|---|---|---|---|
| JP | 57-139432 | * | 8/1982 | 72/347 |
| RU | 1770005 | * | 10/1992 | 72/348 |

* cited by examiner

*Primary Examiner*—Lowell A. Larson
(74) *Attorney, Agent, or Firm*—Vanophem & Vanophem, P.C.

(57) ABSTRACT

An apparatus and method for deep drawing a heavy gage workpiece into a drawn part. A lower die section includes a die cavity therein and a base mounting surface thereon, and further includes a die radius defined between the base mounting surface and the die cavity. Riser blocks mount to the base mounting surface of the die for supporting the workpiece at a predetermined elevation above the base mounting surface of the die. A punch having an end face is capable of reciprocating past the riser blocks and into and out of the die cavity. The workpiece is located on the riser blocks over the die cavity. The punch is advanced from a retracted position into the die cavity, wherein the end face of the punch contacts the workpiece such that the punch and the riser blocks cooperate to pre-form the workpiece therebetween as the punch moves toward the die, but before the workpiece enters the die cavity. Thus, the punch and riser blocks cooperate upon the workpiece to start metal working in areas of the workpiece that are typically prone to defects, in order to prevent such defects.

15 Claims, 4 Drawing Sheets

METHOD OF DEEP DRAWING HEAVY-GAGE PARTS, AND RELATED APPARATUS AND ARTICLE

BACKGROUND OF THE INVENTION

1. Field of the Invention

The present invention generally relates to processes, apparatus, and articles relating to presswork, stamping, and cold forming of metal. More specifically, this invention relates to deep drawing of metal plate into a drawn part for an automotive suspension system.

2. Description of the Related Art

Successful drawing is a process of forming a flat blank of metal, or workpiece, to convert the blank into a hollow shell without unacceptable defects such as cold-shutting, wrinkling, puckering, tearing, thinning, or fracture. The process involves placing the blank on top of a lower die section over an opening die cavity thereof and using an upper die punch to force the blank into the die cavity under forces sufficient to draw the blank past an edge of the opening and into the die cavity, so as to form the hollow shell. Additionally, a ring-like blank holder is usually employed to hold the periphery of the blank in place. The blank is thereby confined between the blank holder and the top of the lower die portion, with the amount of pressure exerted on the blank being sufficient to prevent the part from incurring the above-mentioned defects. Where heavier gage blanks are drawn, however, the thickness of the metal may be sufficiently internally resistant to wrinkling and, therefore, may not require a hold-down device.

Typical metals used for drawing include carbon and alloy steel, and aluminum. Parts that may be drawn include those having simple cylindrical shapes, or more complex geometries having square or rectangular cross sections. For cylindrical shapes, when the depth of the drawn part exceeds the diameter of the part, the process is generally considered to be deep drawing and usually requires multiple progressive drawing operations; otherwise, the process is generally referred to as shallow drawing and can be drawn in one press operation. For rectangular shapes, it is generally known that such parts can be successfully drawn to a maximum depth equal to approximately six times the size of the corner radius on the part without incurring the above-mentioned defects.

Parts that cannot be successfully drawn in one step must, if at all possible, be redrawn in subsequent progressive steps, and often require an annealing operation between such steps to restore the ductility of the metal for further cold working thereof. Such parts tend to be heavy gage sheet metal greater than 0.100" in thickness. Heavier gage parts exceeding 0.250" are characterized as plate steel rather than sheet steel and attempts to successfully deep draw such thicknesses have been limited due to the resistance of such heavy gage materials against entering the draw section of the lower die portion. Defects are often experienced, such as thinning of the wall sections, punching through the bottom of the part, or cracks and splits at the edges or radii of the part. Often times, wrinkling, or cold-shutting, occurs wherein the metal folds over upon itself. Much worse, however, such "experiments" with heavy gage steel often lead to catastrophic damage to the extremely expensive tools and stamping press equipment involved. Therefore, many manufacturers are understandably reluctant to attempt single stroke, single operation deep drawing on such heavy gage plate steel.

Instead, manufacturers typically avoid drawing such parts altogether and use expensive superplastic forming or hydroforming techniques, or attempt to draw the parts in multistep progressive drawing operations using stamping presses with multiple stations. For example, U.S. Pat. No. 4,147,049, to Book et al. teaches a method and machine for drawing heavy-walled parts. Book et al. disclose that the method is carried out on a multiple plunger machine including no less than six separate press stations. Book et al. further disclose that each press station uses a supplemental sleeve that circumscribes a die punch. The sleeve assists the die punch in drawing a cup into a die cavity by contacting an annular edge at an open end of the cup to reduce the tensile stress in the cylindrical portion of the cup.

In another example, U.S. Pat. No. 4,509,356, to Budrean et al. also teaches a method and apparatus for drawing heavy walled shells and points out shortcomings in the teachings of Book et al. Specifically, Budrean et al. assert that the annular edge at the open end of the cup does not always remain perfectly square with the axis of the cup, so that the sleeve cannot uniformly reduce the tensile stress in the cup. Instead, Budrean et al. disclose a method for use on a forming machine that includes no less than seven separate press stations. Each station uses a die punch having a reduced diameter for engaging an inside diameter and bottom portion of the cup. Each die punch also includes an enlarged diameter that defines an annular step. At the first station, the annular step of the die punch forms a complementary annular step at the upper inside diameter of the cup that remains square with the axis of the cup. At subsequent stations, the steps in the subsequent die punches locate on the step in the cup to uniformly reduce tensile stress in the cylindrical portion of the cup.

Unfortunately, both Book et al. and Budrean et al. disclose extremely expensive die arrangements involving multiple stations. Additionally, such processes involve significantly longer process time than a single station process, and necessarily involve more failure modes and downtime than a single station process.

Turning now to a more specific problem in the prior art, forming of leaf spring seats for automotive suspension systems has not been, heretofore, conducive to deep drawing. In particular, 4×4 trucks usually incorporate relatively tall spring seat and spacer block assemblies to provide the appropriate height between the body and the chassis. Such spring seats are generally made from ⅜" thick plate and, therefore, have been impractical to deep draw effectively in one operation to the required height of approximately 3½". As is well known in the art, such a part is not possible to produce in a one-step operation, due to the aforementioned defects that are inherent with a one-step stamping operation, on such a deeply drawn heavy gage part made of steel. For example, it is recognized by those skilled in the art that the maximum overall depth that can be successfully drawn on a rectangular shell having a radius of approximately ¼", as with the present invention, is only approximately 1½".

Before the present invention, attempts to exceed these drawing guidelines typically resulted in thinning at the corners, tearing out in the bottom of the stamped cavity, and wrinkling or cold-shutting at the ends of the leaf spring seat. Therefore, such a part can typically be produced in multiple steps using a progressive die process, as exemplified above by Book et al. and Budrean et al. More typically however, a much shorter leaf spring seat is used in conjunction with a spacer block to achieve the desired height of the parts, as is very well known in the art and exemplified by U.S. Pat. No. 2,678,819 to Douglass. For example, as taught by Douglass, such prior art solutions typically use a relatively short spring seat 6 having a height of approximately 2" in combination with a 1" or taller riser block 8.

Any of the above-mentioned solutions as taught by the prior art are relatively expensive and complex. A multiple-operation progressive die process involves very expensive machinery and tooling, excessive process time, and work-in-process between stations of the stamping press. Similarly, use of a leaf spring bracket and spacer block assembly involves a less robust design, assembly that is more complicated, and a higher overall cost and weight. The spacer block solution is less robust since the spring seat and spacer block inevitably wear against one another, inclusion of extraneous parts tends to increase failure modes within a system, and less precise location of the spring to the spring seat will be achieved. Finally, assembly of the suspension system is needlessly complicated because it entails assembling the extra spacer block.

What is needed, therefore, is a method of deep drawing a heavy gage part that may be accomplished with a single action die and continuous single stroke operation, and does not require a progressive die operation, annealing steps, or use of a blank holder device. Additionally, a spring seat that is deep drawn in a single operation is needed to replace spring seat and spacer block combinations of prior art suspension systems.

BRIEF SUMMARY OF THE INVENTION

According to the present invention, there is provided an apparatus and a method of stamping or deep drawing a heavy gage part that may be accomplished using a single action die with continuous single-stroke press operation, and does not require a progressive die operation, annealing steps, or use of a blank holder device.

In one form of the invention, an apparatus is provided for drawing a heavy gage workpiece into a drawn part. The apparatus includes a lower die section having a die cavity therein and a base mounting surface thereon. The lower die section typically includes a die radius defined between the base mounting surface and the die cavity to assist the entry of the workpiece into the die cavity. Riser blocks are mounted to the base mounting surface of the lower die section for supporting the workpiece at a predetermined elevation or spacing from the base mounting surface of the lower die section. Accordingly, the workpiece is located on top of the riser blocks instead of the base mounting surface. An upper die punch reciprocates past the riser block and into and out of the die cavity. The upper die punch includes an end face thereon that contacts the workpiece as the upper die punch is advanced from a retracted position to a lowered position into the die cavity. The upper die punch and the riser blocks cooperate to pre-draw the workpiece therebetween as the upper die punch moves toward the lower die section, but before the workpiece enters the die cavity of the lower die section. Thus, the upper die punch and riser blocks cooperate to act upon the workpiece to prematurely start metal working in areas of the workpiece that are typically prone to defects.

In another form of the invention, a method of drawing a heavy gage workpiece into a drawn part is provided that includes the following steps. First, a lower die section is provided with a base mounting surface and a die cavity therein, with the lower die section further having a die radius defined between the base mounting surface and the die cavity. Second, at least one riser block is provided and is mounted to the base mounting surface of the lower die section for supporting the workpiece at a predetermined spaced apart distance from the base mounting surface and die cavity of the lower die section. Third, an upper die punch having an end face that reciprocates past the riser block and into and out of the die cavity is provided. Beneath the upper die punch, the workpiece is located on the at least one riser block just above the die cavity. Finally, the upper die punch is advanced from a retracted position to a lowered position into the die cavity, wherein the end face of the upper die punch first contacts the workpiece located on the at least one riser block, such that the upper die punch and the riser block cooperate to pre-draw the workpiece therebetween as the upper die punch moves toward the die cavity, but before the workpiece and upper die punch enter the die cavity of the lower die section.

Specifically, the riser blocks support one surface of the workpiece in areas where defects typically originate. For example, the risers support an area proximate the corners of the workpiece that correspond to end portions of the final part that would otherwise incur cold-shutting defects. Conversely, the upper die punch drives an opposite surface of the workpiece at a central portion thereof, so as to contact, and bend or flow the workpiece between the upper die punch and riser blocks. Thus, the upper die punch and riser block cooperate upon the workpiece to start metal working or flowing, in areas of the workpiece that are typically prone to defects in order to prevent such defects from occurring as the single stroke punch continues to push the metal workpiece into the die cavity so as to progressively conform the bottom of the workpiece to the bottom of the die cavity and simultaneously form each of the corners and straighten out sidewalls to final form. By beginning to form corners of the workpiece before it enters the cavity, heat is generated by the metal forming and assists in forming the bottom and walls of the workpiece without wrinkles or other aforementioned defects.

In a final form of the invention, an article, such as a spring seat, is produced by the method of the present invention as described above.

Accordingly, it is an object of the present invention to provide an apparatus and method to pre-form a blank of material before the blank enters or contacts a die cavity by locating at least one riser around the periphery of the die cavity, such that the blank is introduced to the die cavity at an oblique or acute angle of incidence rather than from a horizontal plane.

It is another object to provide an apparatus and method for deep drawing a heavy gage blank in a single station press, single action operation without the blank incurring significant drawing defects.

It is yet another object to provide an apparatus and method for forming, in a single hit, a drawn part from a steel workpiece whose depth significantly exceeds six times the size of the corner radii of the part.

It is still another object to provide an apparatus and method for deep-drawing a heavy gage part that is less expensive and that requires less process time than conventional progressive die forming of such parts.

It is a further object to provide an apparatus and method for deep-drawing a heavy gage part that requires only a single station rather than several progressive stations, and therefore has less failure modes and downtime.

It is yet a further object to replace a multiple piece spring seat and spacer block combination with a one piece spring seat of equivalent effective height.

It is still a further object to provide a lower die section having upright extensions extending therefrom for locating a workpiece thereon and that contributes to accomplishing the above-listed objects.

It is another object to provide an apparatus and method for stamping a heavy gage part on a single station press where pre-forming of the workpiece occurs before the workpiece enters the die cavity so that heat generated by such pre-forming assists in the formation of a deep drawn heavy gage metal workpiece.

It is another object to provide an apparatus and method for stamping a deep drawn part wherein work performed on the workpiece before the workpiece enters the die cavity generates heat so as to begin flow of the metal in the areas of the blank that are subject to unacceptable defects.

It is another object to provide an apparatus and method for stamping a deep drawn part wherein heat generated in the workpiece prior to the punch entering the cavity of the die is utilized in subsequent forming of the workpiece to assist in flowing of the metal within the cavity of the die so as to assist in the formation of the bottom and sides of the workpiece of a deep drawn workpiece.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
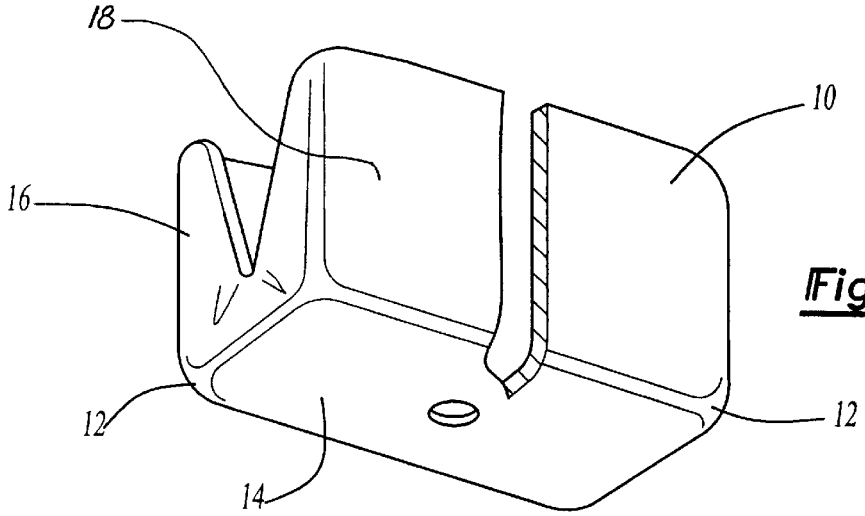
FIG. 1 is a partially cutaway perspective view of an article manufactured using the method of the present invention, the article being in the form of a spring seat component for an automobile leaf spring suspension system.

Referring now in detail to the Figures, there is shown in FIG. 1 an article, or drawn part, according to the present invention. FIG. 1 illustrates the article as a leaf spring seat 10, in the shape of a rectangular shell for welding to a rear axle of a motor vehicle, and to which leaf springs are mounted. The leaf spring seat 10 has a bottom 14, ends 16, sides 18, and corners 12 therebetween. Furthermore, the thickness of a workpiece or blank used to make the leaf spring seat 10 is approximately ⅜", as cut from ⅜" SAE 1008 or 1010 steel plate. The overall depth, or height, of the leaf spring seat 10 is approximately 3½" and the corner radii are approximately ¼", for a ratio of over 12:1. For rectangular parts, this depth, given the corner radii, is over double the previously known maximum overall depth that could be successfully drawn in a single hit of a steel blank.

Figure 2:
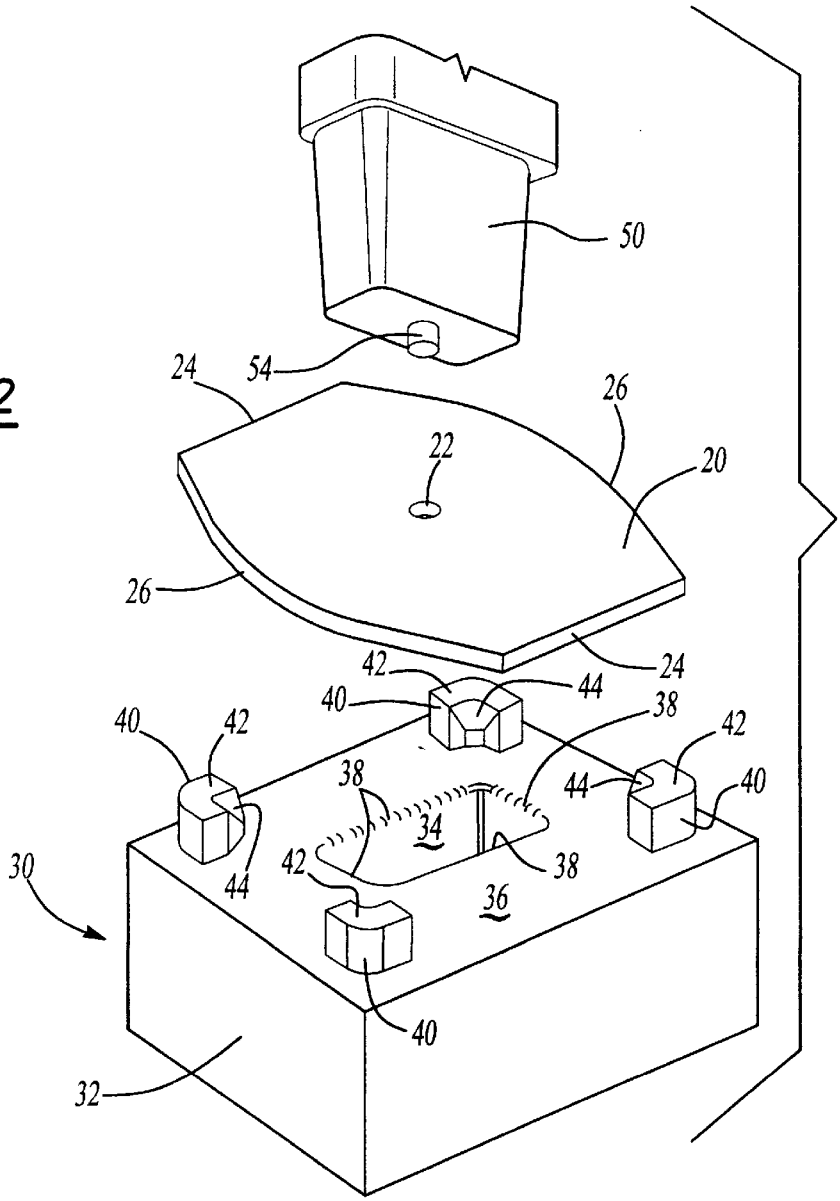
FIG. 2 is a perspective view of a metal blank oriented between the bottom of an upper die punch and the top of a lower die section having a cavity formed therein, according to the present invention.

The leaf spring seat 10 is drawn from a blank or workpiece 20 having the shape as shown in FIG. 2. Referring now to FIG. 2, the workpiece 20 includes a pilot hole 22, flat sides 24, and rounded ends 26 that are transverse to the flat sides 24, with the rounded ends 26 corresponding to the ends 16 of the leaf spring seat 10 of FIG. 1. To form the leaf spring seat 10 of FIG. 1, the workpiece 20 is formed by an upper die punch 50 against and into a lower die section and riser assembly 30 as shown beneath the workpiece 20. The upper die punch 50 is mounted to a slide of a stamping press (not shown) and the lower die section and riser assembly 30 are mounted to a bolster plate attached to a bed (not shown) of the stamping press, as is very well known in the art. The stamping press is preferably a standard Minster 250 ton press operated at a speed of roughly thirty strokes per minute, employing known commercially available deep drawing lubricants.

Still referring to FIG. 2, the lower die section and riser assembly 30 includes a lower die section 32 having a die cavity 34, a base mounting surface 36, and a radiused entrance edge or die radius 38 that provides a transition between the base mounting surface 36 and the die cavity 34. Preferably, the die cavity 34 is sized slightly larger than the desired outside dimensions of the final part to permit expansion of the workpiece 20 due to heat generated during forming, and to permit easy ejection of the formed part from the die cavity 34. As shown, four riser blocks 40 are mounted to the base mounting surface 36 of the lower die section 32. The riser blocks 40 may be welded, cap-screwed, or otherwise machined into the lower die section 32 itself. Each riser block 40 is positioned so as to surround the die cavity 34, just radially outboard of the die cavity 34 or die radius 38, since the pre-forming and metal flow is required to begin before the workpiece 20 enters the die cavity 34. The riser blocks 40 contribute to reduction or prevention of defects in corresponding portions of the workpiece 20 that are typically prone to defects. The exact location of the riser blocks 40 will vary with different workpiece geometries and, therefore, must be determined with some limited experimentation for any given workpiece geometry.

Furthermore, each riser block 40 has a locating surface 42 parallel to the base mounting surface 36 of the lower die section 32. Each riser block 40 also includes a contoured or sloped portion 44 that is formed concave as shown, or may be formed as a straight slope, convex, or as a radius—as is required for the particular type of part that is being drawn. Preferably, the height of the riser blocks 40 is approximately twenty percent of the height of the final part to be formed. Alternatively, however, it is anticipated that the height may be anywhere from one to one-hundred percent of that of the final part to be formed. Again, different workpiece geometry will necessitate some experimentation to determine the optimum height required. Ultimately, however, the function of the riser blocks 40 is to elevate or space the workpiece 20 from the die cavity 34 of the lower die section 32, so as to permit pre-forming or metal flow of the workpiece 20 between the riser blocks 40 and the upper die punch 5o, before entering the die cavity 34.

Figure 3:
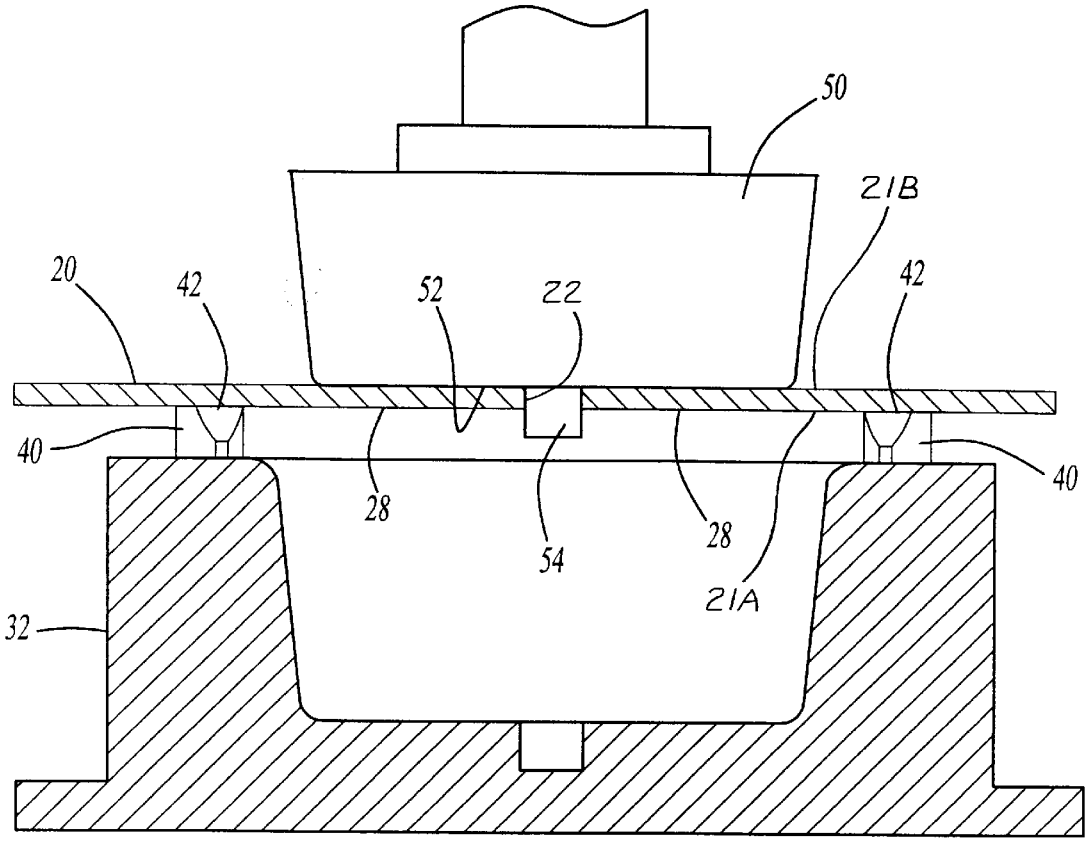
FIG. 3 is a cross-sectional view of a deep draw upper die punch and die apparatus according to the present invention, showing the metal blank resting on riser blocks that surround the cavity in the die and showing the upper die punch in initial engagement with the metal blank.

Referring now to FIG. 3, there is illustrated a longitudinal cross-section of the apparatus of the present invention. In addition to the lower die section 32, riser blocks 40, and workpiece 20, the upper die punch 50 is now shown aligned with the die cavity 34 (shown in FIG. 2) over the lower die section 32 as is known in the art. The upper die punch 50 reciprocates into and out of the lower die section 32, as is known in the art, such that the upper die punch 50 reciprocates past the riser blocks 40 and into the die cavity 34, thereby drawing the workpiece 20 into the lower die section 32 so as to produce the formed part. The riser blocks 40 represent a novel and unobvious improvement over prior art deep drawing equipment, since such a die configuration has not been attempted nor even suggested before.

As shown, a lower surface or rest face 21A of the workpiece 20 is resting on the locating surfaces 42 of the riser blocks 40, over the die cavity 34. The upper die punch 50 is shown during its downstroke in initial engagement against an upper or punch surface 21B in a central portion 28 of the workpiece 20. The upper die punch 50 has been advanced from a retracted position above the workpiece 20 to the position of initial engagement, as shown. The upper die punch 50 includes an end face 52 for engaging the workpiece 20 and also includes a pilot 54 for engaging the pilot hole 22 to locate the workpiece 20 relative to the upper die punch 50. As shown, the workpiece 20 is engaged by the upper die punch 50 and the riser blocks 40, but does not yet engage any portion of the lower die section 32 itself.

Figure 4:
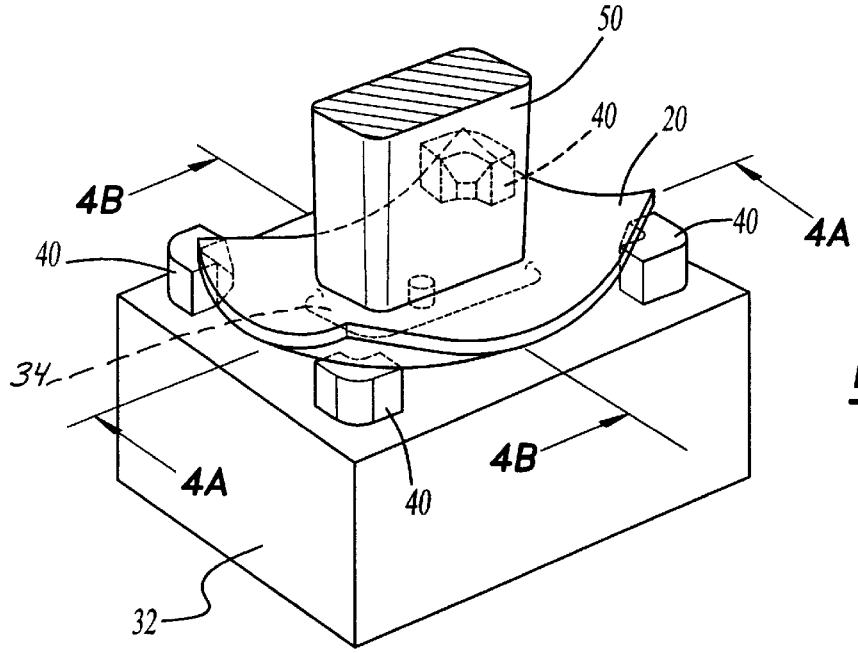
FIG. 4 is a perspective view of the apparatus of FIG. 3, showing the upper die punch partially stroked downward beyond the initial engagement position toward the lower die section to pre-form the metal blank.

As shown in perspective in FIG. 4, the upper die punch 50 continues to advance toward the die cavity 34. The upper die punch 50 and the riser blocks 40 cooperate to pre-draw the workpiece 20 therebetween as the upper die punch 50 moves downward toward the die cavity 34 in the lower die section 32 but before the workpiece 20 enters the die cavity 34. Specifically, the riser blocks 40 support the workpiece 20 in areas where defects typically originate - in this case just inboard of the corners of the workpiece. In one continuous downward motion, the upper die punch 50 drives the workpiece 20 at a central portion thereof, so as to contact and pre-form the workpiece 20 between the upper die punch 50 and riser blocks 40. Thus, the upper die punch 50 and riser blocks 40 cooperate to prematurely start metal working, or pre-forming, in the form of metal flow, or bending, in areas of the workpiece 20 that are typically prone to defects. The workpiece 20 is typically prone to defects in the corners that, due to compressive stresses between the upper die punch 50 and die cavity 34, tend to cold-shut or fold over upon themselves instead of drawing smoothly into a desired shape.

Figure 4A:
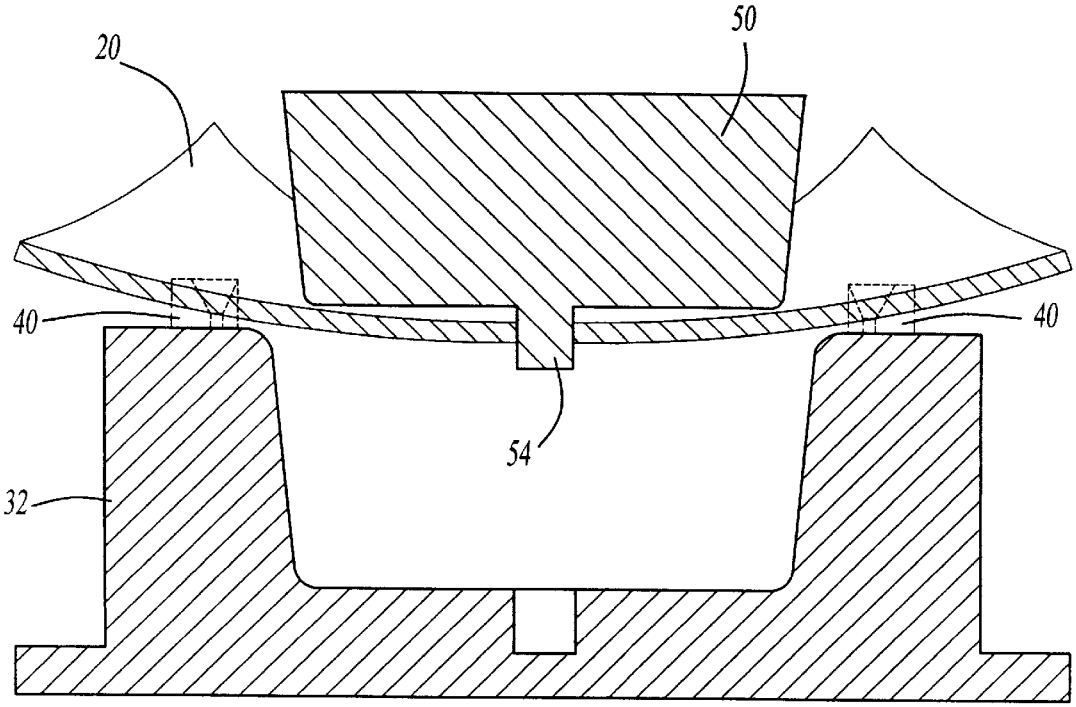
FIG. 4A is a cross-sectional view of FIG. 4 taken along lines 4A—4A thereof.
Figure 4B:
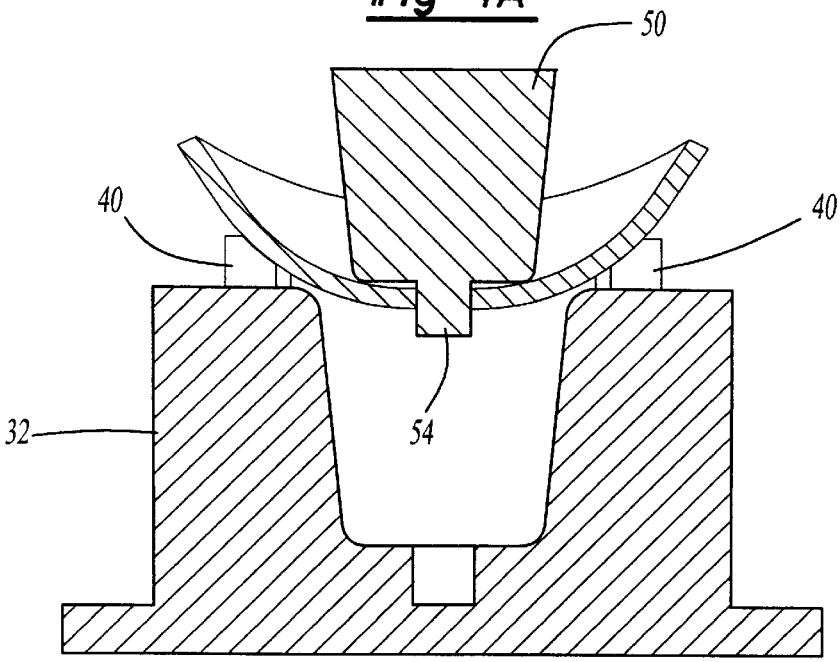
FIG. 4B is a cross-sectional view of FIG. 4 taken along lines 4B—4B thereof.

Referring now to FIG. 4A, there is illustrated, in longitudinal cross section, the workpiece 20 being pre-drawn by the upper die punch 50 and riser blocks 40 before the workpiece 20 enters the die cavity 34 (shown in FIG. 2). Similarly, FIG. 4B illustrates, in transverse cross section, the workpiece 20 being pre-drawn by the upper die punch 50 and riser blocks 40 before entering the die cavity 34. Accordingly, the upper die punch 50 has been advanced downward from an upward retracted position, advanced beyond its initial engagement position as shown in FIG. 3, and advanced to the position as shown in one continuous stroke. Thus, metal bending, or metal flow, begins to occur before the upper die punch 50 draws the workpiece 20 into the die cavity 34, wherein compressive stresses force the workpiece 20 metal into the desired shape of the leaf spring seat 10. As a result, the riser blocks 40 act to "shoehorn" the workpiece 20 into the die cavity 34 in order to mitigate the compressive stresses that, before the present invention, would create defects in the workpiece 20 such as cold shutting, wrinkling, tearing, etc. In other words, the workpiece 20 is introduced to the die cavity 34 at a steep angle of incidence rather than from a horizontal plane.

Furthermore, the metal working, in the form of metal bending and flowing of the workpiece 20 between the upper die punch 50 and riser blocks 40, generates heat so as to begin and enhance flow of the metal in predetermined areas of the workpiece 20, before the workpiece 20 ever contacts the lower die section 32 or enters the die cavity 34. In other words, pre-forming the workpiece 20 in this way tends to have an annealing affect on the workpiece 20 for enchanced drawability of the workpiece 20 into the die cavity 34. In other words, the upper die punch 50 and riser blocks 40 cooperate upon the workpiece 20 to start metal working or flowing, in areas of the workpiece 20 that are typically prone to defects in order to prevent such defects from occurring, as the single stroke upper die punch 50 continues to push the metal workpiece 20 into the die cavity 34 so as to progressively conform the bottom of the workpiece 20 to the bottom of the die cavity and simultaneously form each of the corners and straighten out the sidewalls to final form. By beginning to form corners of the workpiece 20 before it enters the cavity, heat is generated by the metal forming and assists in forming the bottom and walls of the workpiece 20 without wrinkles or other aforementioned defects.

Figure 5:
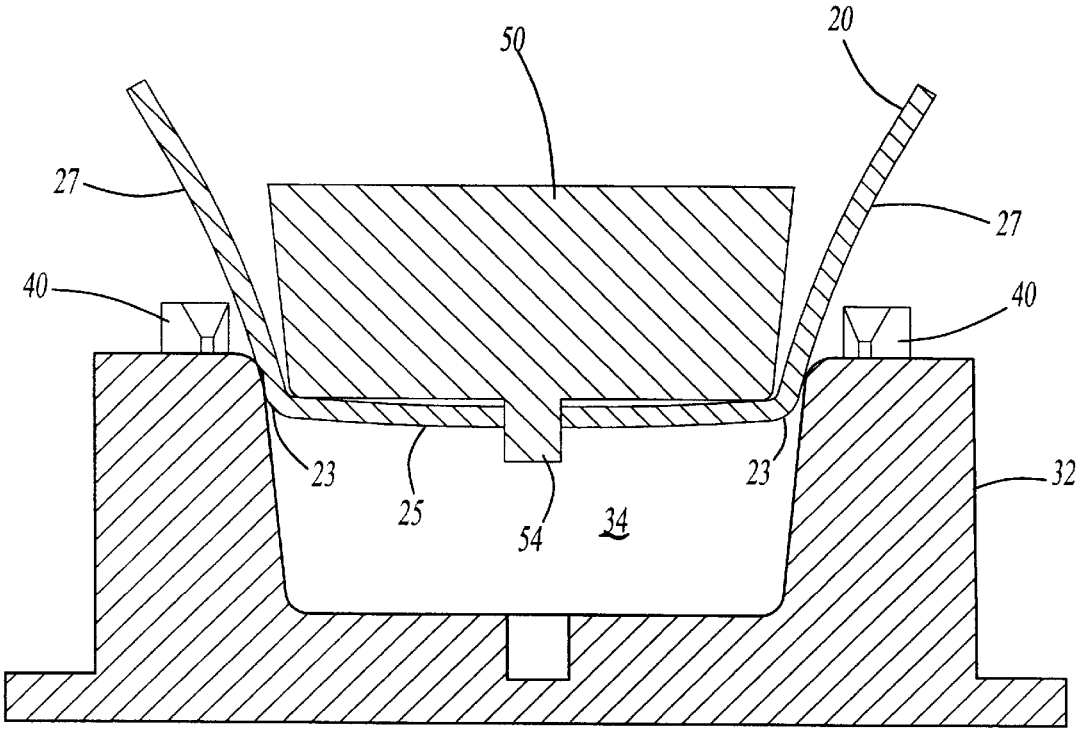
FIG. 5 is another cross-sectional view of the apparatus of FIGS. 3 and 4, showing the upper die punch stroked further downward into the lower die section and the metal blank beginning to engage the die.

Referring now to FIG. 5, the workpiece 20 is preferably engaged with the die cavity 34 after it is disengaged from the riser blocks 40. Accordingly, as shown in FIG. 5, corners 23, ends 27, bottom 25, and sidewalls (not shown) of the workpiece 20 are drawn between the upper die punch 50 and lower die section 32 to form the sides 18 and ends 16 of the leaf spring seat 10 of FIG. 1. Referring again to FIG. 5, as is known in the art, the lower die section 32 may include a die cushion (not shown) to assist with ejecting the final part.

From the above, it can be appreciated that a significant advantage of the present invention is that a heavy gage metal plate may be deep drawn into a high quality finished part having relatively small radii, by using a single action, single stroke operation with a standard stamping press, punch, and die by beginning metal working before the workpiece and punch enter the die cavity. Therefore, defects such as cold-shutting, wrinkling, or puckering are not significantly incurred using the present invention.

An additional advantage is that a single leaf spring seat is inexpensively produced and achieves the same height, with only one part, as prior art leaf spring seat and spacer block combinations, thereby eliminating the need to use a shallow drawn spring seat in combination with a spacer block. Accordingly, by eliminating the spring seat and spacer block that tend to wear against each other, the present invention thereby eliminates associated squeaks or vibrations in the vehicle. Further, the present invention will not require any additional fasteners to hold the spacer block to the spring seat.

Another advantage is that neither a multiple station nor multiple stroke drawing operation is required because the depth of the part is successfully drawn to more than three inches in height, thereby nearly doubling the previously known drawing capability. Die life is not compromised, and no unusual die impairment such as scoring and die lines have been observed.

It must be pointed out that the above description provides one with skill in the art the requisite disclosure to practice the present invention. Nonetheless, it is well known in the art that deep drawing processes are particularly sensitive and inherently require some limited experimentation with process variables such as lubrication, clearance, material properties, and die geometry that vary for any given part shape or geometry.

While the present invention has been described in terms of a preferred embodiment, it is apparent that other forms could be adopted by one skilled in the art. For example, the riser blocks could be integrated from four individual pieces, into one ring-like member. The riser blocks could also take on vastly different shapes, or be positioned in alternative locations on the base mounting surface of the lower die section. Finally, the orientation of the apparatus need not be limited to a downstroke-only type of operation. In other words, the apparatus could be inverted so that the workpiece and upper die punch are beneath the die, such that gravity could aid in ejecting the workpiece. Additionally, the apparatus could be placed on its side or in a horizontal, instead of vertical, fashion. Accordingly, the scope of the present invention is to be limited only by the following claims.

What is claimed is:

1. An apparatus for drawing a heavy gage workpiece into a drawn part, said apparatus comprising:

a lower die section comprising a base mounting surface thereon and a die cavity in said base mounting surface;

riser means, mounted to said base mounting surface of said lower die section, for supporting the workpiece a spaced apart distance from said base mounting surface of said lower die section; and a punch adapted to reciprocate past said riser means, said punch having an end face thereon;

wherein the workpiece is located on said riser means over said die cavity, such that as said punch is advanced or retracted position to a lowered position into said die cavity, said end face of said punch contacts the workpiece, said punch and said riser means cooperating to pre-draw the workpiece as said punch moves toward said lower die section but before the workpiece enters said die cavity, thus prematurely starting metal flowing in predetermined areas of the workpiece.

2. The apparatus as claimed in claim 1, wherein said riser means extends from said base mounting surface.

3. The apparatus as claimed in claim 1, wherein said riser means comprises separate individual components that are mounted to said base mounting surface of said lower die section.

4. The apparatus as claimed in claim 1, wherein said riser means comprises separate individual components that are fastened onto said base mounting surface of said lower die section.

5. A method of drawing a heavy gage workpiece into a drawn part, said method comprising the steps of:

providing a lower die section comprising a base mounting surface thereon and a die cavity in said base mounting surface, said lower die section further comprising a die radius defined between said base mounting surface and said die cavity;

providing riser means for supporting the workpiece a predetermined spaced apart distance from said base mounting surface of said lower die section, said riser means being mounted to said base mounting surface of said lower die section;

providing a punch that reciprocates past said riser means to contact said workpiece and pre-form said workpiece before entering said die cavity, said punch having an end face thereon;

locating the workpiece on said riser means over said die cavity; and advancing said punch from a retracted position into said die cavity, said end face of said punch contacting the workpiece, said punch and said riser means cooperating to pre-draw the workpiece therebetween as said punch moves toward said lower die section but before the workpiece enters said die cavity, thus prematurely starting metal working in predetermined areas of the workpiece.

6. An article produced by the method as claimed in claim 5.

7. The article as claimed in claim 6, wherein said article is a leaf spring seat having a rectangular shell shape.

8. The article as claimed in claim 7, wherein said leaf spring seat is over three inches in height, is produced from stock approximately three-eighths of an inch thick, and includes radii of approximately one-quarter of an inch.

9. An apparatus for drawing a heavy gage workpiece into a drawn part, said apparatus comprising:

a lower die section comprising a base mounting surface thereon and a die cavity in said base mounting surface;

at least one riser block mounted to said base mounting surface of said lower die section, said at least one riser block being positioned outboard of said die cavity and supporting the workpiece in predetermined areas thereof, said at least one riser block further supporting the workpiece at a predetermined spaced apart distance from said base mounting surface of said lower die section; and a punch that advances past said at least one riser block into said die cavity for drawing the workpiece into said die cavity, said punch having an end face thereon;

wherein the workpiece is located on said at least one riser block over said die cavity, such that as said punch is advanced from a retracted position into said die cavity, said end face of said punch contracts the workpiece, said punch and said at least one riser block cooperating to pre-draw the workpiece therebetween as said punch moves toward said lower die section but before the workpiece enters said lower die cavity, thus prematurely starting metal working in predetermined areas of the workpiece.

10. The apparatus as claimed in claim 9, wherein said at least one riser block is machined from stock as part of said lower die section.

11. The apparatus as claimed in claim 9, wherein said at least one riser block comprises separate individual components that are welded to said base mounting surface of said lower die section.

12. The apparatus as claimed in claim 9, wherein said at least one riser block comprises separate individual components that are fastened onto said base mounting surface of said lower die section.

13. The apparatus as claimed in claim 9, wherein said at least one riser block comprises four riser blocks positioned proximate respective corners of said die cavity of said lower die section.

14. The apparatus as claimed in claim 9, wherein said at least one riser block has a height between five to fifty percent of that of the height of the drawn part.

15. A die comprising:

a die section comprising a base mounting surface thereon and a die cavity in said base mounting surface; and at least one riser member mounted to said base mounting surface of said die section, said at least one riser member supporting a workpiece a spaced apart distance above said base mounting surface of said die section.

* * * * *

UNITED STATES PATENT AND TRADEMARK OFFICE

CERTIFICATE OF CORRECTION

PATENT NO. : 6,474,126 B1
DATED : November 5, 2002
INVENTOR(S) : Robert H. Webster It is certified that error appears in the above-identified patent and that said Letters Patent is hereby corrected as shown below:

Title page,
Item [74], delete "Vanophen & Vanophen, P.C." and insert
-- VanOphem, & VanOphem, P.C. --.

Column 1,
Line 18, after "opening" insert -- or --.

Column 5,
Line 59, after "shell" insert a comma -- , --.

Column 7,
Line 62, after "cold" insert a hypen -- - --.

Column 10,
Line 33, delete "contracts" and insert -- contacts --.

Signed and Sealed this

Eleventh Day of March, 2003

JAMES E. ROGAN
*Director of the United States Patent and Trademark Office*